United States Patent [19]

Leimbacher et al.

[11] 3,960,484

[45] June 1, 1976

[54] PROCESS AND APPARATUS FOR IMPROVING THE FIBER STRUCTURE OF TEXTILE MATERIAL CONTAINING CELLULOSE FIBERS

[75] Inventors: Erwin Leimbacher, Wattwil; Walter Marte, Ulisbach; Ferdinand Buchele, Wattwil, all of Switzerland

[73] Assignee: Herberlein Textildruck AG, Wattwil, Switzerland

[22] Filed: Feb. 12, 1974

[21] Appl. No.: 441,839

[30] Foreign Application Priority Data

Feb. 14, 1973 Switzerland ..... 2170/73

[52] U.S. Cl. ..... 8/125

[51] Int. Cl.[2] ..... D06M 1/02

[58] Field of Search ..... 8/125

[56] References Cited

UNITED STATES PATENTS

| | | | |
|---|---|---|---|
| 1,316,958 | 9/1919 | Jones | 8/125 |
| 1,717,991 | 6/1929 | Melliand | 8/125 X |
| 2,142,043 | 12/1938 | Boyd | 8/125 |
| 2,203,375 | 6/1940 | Weiss | 8/125 |
| 2,447,914 | 8/1948 | Ruperti | 8/125 X |

OTHER PUBLICATIONS

Ott et al., – Cellulose Part I, (Textbook)–1955–p. 326.

*Primary Examiner*—Carman J. Seccuro
*Attorney, Agent, or Firm*—Fitzpatrick, Cella, Harper & Scinto

[57] ABSTRACT

Process and apparatus for improving the fiber structure of textile material containing cellulose fibers, wherein the material is impregnated with a swelling agent, is squeezed off, stretched, washed and cooled after squeezing and before stretching.

20 Claims, 1 Drawing Figure

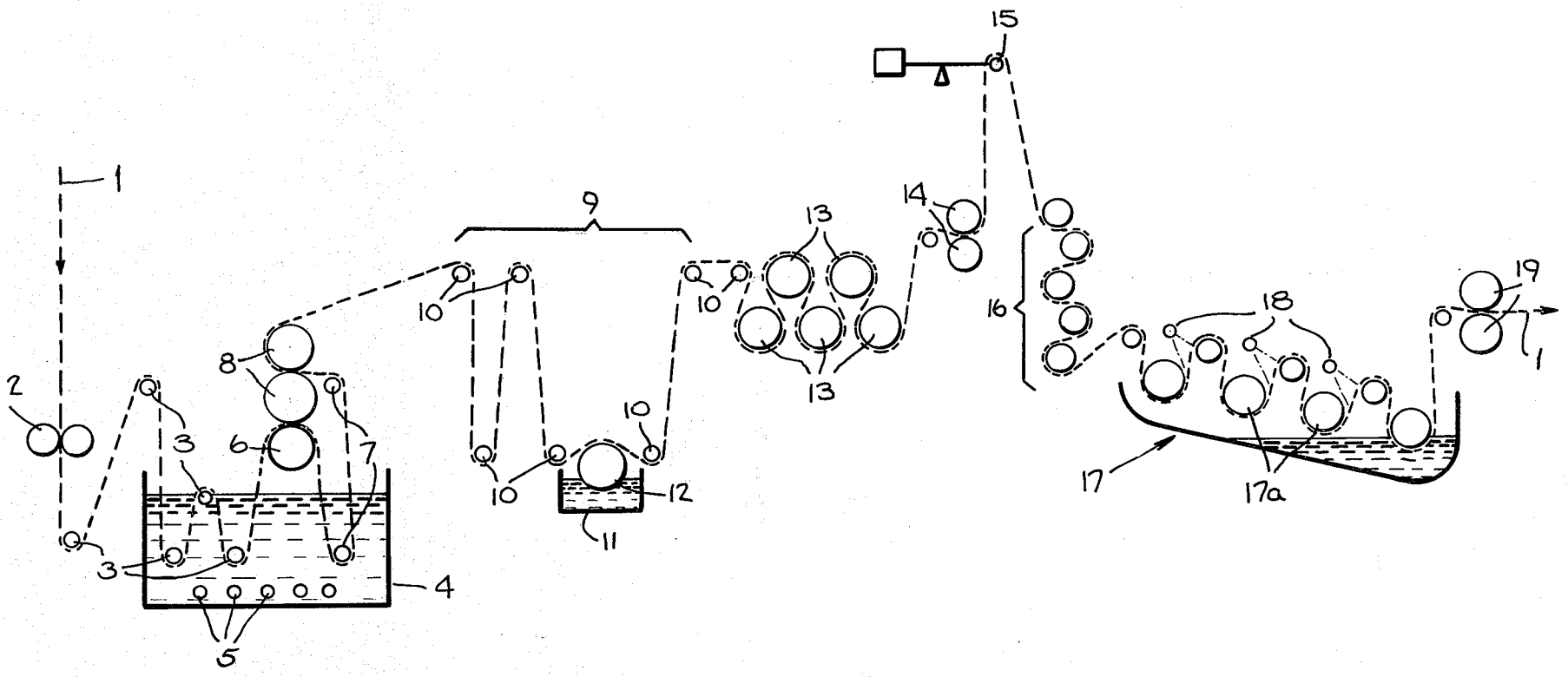
1
2
3
4
5
6
7
8
9
10
11
12
13
14
15
16
17
17a
18
19

PROCESS AND APPARATUS FOR IMPROVING THE FIBER STRUCTURE OF TEXTILE MATERIAL CONTAINING CELLULOSE FIBERS

The present invention relates to a process and an apparatus for improving the fiber structure of cellulose-containing textile material by means of swelling agents.

It is known to treat textile fabrics containing cellulose fibers with a sodium hydroxide solution of mercerising strength at room temperature under conditions which permit shrinkage, thereafter to subject the fabric in swollen condition to controlled stretching and finally to wash it under fixed dimensions. By this treatment, it is intended to reduce tensions inherent to the individual fibers due to their growth as well as additional tensions existing due to their manufacture, which tensions cause unsatisfactory strength, insufficient dimensional stability and a high creasing tendency in flat structures such as fabrics. Additionally, this treatment is intended to increase the accessibility to dyestuffs and finishing agents by opening and equalizing the structure.

The intended purposes are, however, not achieved to the desired extent by the known processes. This treatment has particularly disadvantageous effects in connection with subsequent high finishing treatments, i.e. the cross-linkage of the cellulose with so-called reactant resins, since such cross-linkage considerably reduces the strength of the textile material and since, to achieve satisfying creasing strength, relatively large quantities of reactant resins are necessary. For achieving the best possible swelling effect, in practice, relatively long dipping periods of approximately 60 seconds are usual; and in modern machines with material speeds of between 60 and 80 meters per minute, such dipping periods call for dipping troughs of a substantial length, and for a proportionately large volume of swelling agent.

Accordingly, we contribute by our invention a process by which it is possible to avoid or at least substantially reduce the disadvantages of the known processes and to achieve optimal conditions for improving the fiber structure of cellulose-containing textile material.

According to the present invention, we resolve this problem by imbibing the textile material in a solution of swelling agent heated to at least 50°C for not more than 15 seconds, thereafter cooling the material to a temperature below 25°C, and then stretching and washing same. By the treatment with swelling agents according to the present invention, the interfibrillary and molecular bonds are separated to a great extent and therefore, in the subsequent stretching, an essentially improved order in the fibrillary range is obtained, which is of decisive importance for the desired properties and the behaviour in finishing of the textile material.

The process according to the present invention is applicable to textile material such as yarns, and woven and knitted fabrics which consist in part or entirely of native or regenerated cellulose, such as, for example, textile material of cotton, bast fibers, spun rayon, mixtures of cotton spun rayon and synthetic fibers. Thereby, the dry as well as the wet textile material may be subjected to treatment according to the present invention in raw, desized, or in lye-steeped and bleached condition.

For the execution of the process, heated alkali hydroxide solution, especially sodium hydroxide solution of between about 15° and 30° Be or a lithium hydroxide solution of a concentration of between approximately 5 and 10 percent are especially suitable. All these agents may be used in the form of aqueous solutions heated to temperatures of the order of between 50° and 95°C, the impregnating time amounting usually to between about 4 and 10 seconds. Furthermore, low-molecular aliphatic alcohols, such as, for example, methanol, ethanol, n-propanol, n-butanol may be added, preferably in quantities of the order of between 0.5 and 5 volume percent. The high temperature of swelling agent solution induces good wettability of the fiber and rapid and uniform diffusion of the swelling agent even into the center of the fiber. The addition of small quantities of alcohols helps further to improve the wetting and to delay swelling in the outer fiber zone, which in turn further accelerates the diffusion of the swelling agent into the fiber center. By the described measures, the whole cross-section of the fiber is swollen even under unfavourable conditions such as for example, when treating raw textile materials.

It is, however, also possible to use organic swelling agent solutions, especially solutions of amines, examples of which are alkyl amines and their homologues, aliphatic diamines and their homologues, aromatic amines, and heterocyclic nitrogen compounds such as pyridine, morpholine, and quaternary organic ammonium hydroxides.

Since shrinkage of the textile material occurs during impregnating with the swelling agent solution, it is advantageous to eliminate any traction on the textile material by controlling the input speed during this procedure. Furthermore, the loosening of the textile material improves its ability to imbibe the solution.

In order to achieve the best possible swelling of the fibers, the textile material, impregnated with the above-mentioned swelling agent solution and squeezed off, may be passed for at least 6 seconds through a storage zone in which, if necessary, swelling agent solution may again be brought onto the material. Thereupon, the textile material is cooled to a temperature of between 5° and 25°C during between 5 and 20 seconds, since the degree of swelling necessary for the desired inner transformation of the fiber structure is only achieved at such temperatures. For this purpose, the textile material may be passed over cooled rollers preferably arranged so that the sides of the material alternately contact a roller, or through a swelling agent solution of between about 0° and 20°C. It is advantageous to subject the textile material in the zone between impregnating with the swelling agent solution and cooling to controlled shrinkage in longitudinal direction to a predetermined extent, preferably shrinkage of the order of between 0.5 and 10 percent.

After passage through a further pair of squeezing rollers, the textile material is stretched in known manner in longitudinal and transverse direction, washed with hot and cold water and eventually neutralized with an aqueous solution containing a small quantity of acid.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent construction as do not depart from the spirit and scope of the invention.

Specific embodiments of the invention have been chosen for purposes of illustration and description, and are shown in the accompanying drawing, forming a part of the specification wherein the single FIGURE is a schematic view of one form of the apparatus of our invention.

The textile material length 1, fed by means of the feeding device 2 consisting of a pair of rollers, is passed over leading rollers 3 into and through the dipping trough 4, is removed by means of the feeding roller 6 and reaches the pair of squeezing rollers 8 via further leading rollers 7, one of which is beneath the surface of the solution. In the bottom of trough 4, we provide tubes 5 which are fed with steam indirectly to heat the swelling agent solution. Furthermore, a device (not shown) for pre-evacuating the textile material lengths may be provided upstream of the dipping trough 4. The drives (not shown) of the feeding device 2, the feeding roller 6 and the pair of squeezing rollers 8 can be adjusted with respect to each other so that a relaxation of the length of material 1 is obtained during impregnation. The length of textile material 1 then reaches a storage zone 9 in which it is led over a number of rollers 10. By means of the liquid application roller 12 partially dipping into the trough 11 containing the swelling agent solution, such solution is again applied onto the length of textile material 1. Instead of the liquid application roller 12, for subsequently applying swelling agent solution onto the length of textile material 1, a spraying device may be used.

The length of textile material is now led over a number of cooling rollers 13, the driving speed of which can be regulated. These cooling rollers have a double jacket (not shown) in which circulates a cooling agent. Thereafter, the length of textile material 1, is passed over a second pair of squeezing rollers 14, and upon passage over the pendulum roller 15 is subjected to lengthwise stretching and to transverse stretching by means of the spreading rollers 16. The material then passes through a washing device 17 comprising rollers 17*a* and spraying tubes 18, by means of which the solution of swelling agent is removed, as well as a third pair of squeezing rollers 19 which inter alia provides the necessary lengthwise pull.

The drives of the pairs of squeezing rollers 8, 14 and 19 as well as of the individual cooling rollers, can be adjusted in respect of each other by means of difference measuring devices so that controlled lengthwise shrinkage of the length of textile material 1 occurs between the pairs of squeezing rollers 8 and 14 and controlled lengthwise stretching between the pairs of squeezing rollers 14 and 19.

From the foregoing description, it will be seen that the process of the present invention in connection with the described device for effecting the same has many advantages. Optimal improvement of the fiber structure of cellulose-containing textile material can be obtained which brings an essential increase of tensile strength and a considerable improvement of the creasing tendency. Thereby, in the shrinkfree, crease-free and durable press finishing of cellulose-containing textile material, smaller quantities of synthetic resins are needed, whereby also the loss of tensile strength due to cross-linking is reduced. The higher initial tearing strength and the smaller loss of strength due to finishing decisively improve the utility of the finished textile material. The optimal improvement of fiber structure may also be achieved in the treatment of the raw textile material whereby a preceding lye-steeping or bleaching step may be ommitted in certain cases.

Because of the very brief period of impregnation, it is possible to use relatively short imbibition troughs with accordingly small quantities of swelling agent solution. Thereby, less soiled swelling agent solution is produced, and the cost of its regeneration is reduced. Furthermore, essential lengthwise reduction of the dimensions of the machine can be achieved which facilitates its incorporation in a continuous pretreatment processing installation.

For further illustration of the invention, the following examples are given hereinafter:

EXAMPLE I

A desized cotton poplin fabric was introduced by means of the device described and illustrated in the drawing, into the soaking trough 4 in dry condition, the trough containing sodium hydroxide solution of 30° Be heated to 95° ± 2°C. The fabric length was impregnated with the solution for 5 seconds, squeezed off and passed through the storage zone for 3 seconds where it was once more impregnated with the sodium hydroxide solution of the same concentration by means of the liquid application roller 12. The fabric length was then passed over the cooling rollers 13 for 7 seconds and thereby cooled to a temperature of 18° ± 2°C. The drives of the squeezing roller pairs 8 and 14 were so adapted to each other that the fabric was subjected to controlled shrinking of approximately 5 percent in longitudinal and transverse direction. The fabric length was stretched in the stretching device 15, 16 between 5 and 8 percent in longitudinal and transverse direction and finally was washed in the washing device 18. The thus treated fabric had a tensile strength between 50 and 60 percent higher than that of the raw fabric and was characterized by an excellent lustre.

EXAMPLE II

A cotton satin fabric of 125 g/m$^2$ to be printed, after singeing, desizing, and squeezing in wet condition, was introduced into the soaking trough 4 which contained a sodium hydroxide solution of 20° Be heated to 90° ± 2°C. The fabric length was passed through the heated swelling agent solution for 10 seconds, then passed also for 10 seconds through a second dipping trough containing the same swelling agent solution which was, however, held at a temperature of 20°C without first passing through a storage zone, and finally was squeezed off. Between the pairs of squeezing rollers 8 and 14, the fabric was subjected to shrinkage of between approximately 1 and 2 percent in longitudinal and transverse direction, and was also stretched between 1 and 2% in both directions in the stretching device 15, 16 whereupon it was washed under fixed dimensions. The thus treated fabric was shown to have an increase of tensile stretch with respect to the raw fabric of approximately 40 to 50 percent, and demonstrated very good dye-stuff receptivity.

EXAMPLE III

An assembly of parallel-led raw cotton ply-yarns was continuously passed in dry condition through a soaking trough which contained a sodium hydroxide solution of 28° Be heated to 50° ± 2°C with an addition of 2.5 colume % n-propanol. The yarns were passed through the heated swelling agent solution for 5 seconds and then squeezed off, the advance speeds upon entry of the ply-yarns into the swelling agent solution and upon issue from the same being chosen so that pull reduction occurred and the ply-yarns shrank by up to 5 percent.

Thereupon, the ply-yarns were passed over cooling rollers for 5 seconds, and cooled to a temperature of approximately 20°C and thereupon squeezed off once more, the advance speeds upon entry of the ply-yarns into the cooling zone and upon issue therefrom being chosen so that the ply-yarns were once more subjected to shrinkage of approximately 2 percent, with respect to raw dimensions. After cooling, the ply-yarns were subjected to stretching by 4% with respect to the original dimensions and washed in this condition. The thus contained ply-yarns were characterized by excellent lustre, a very good dye-stuff receptivity and a tensile strength increased by approximately 50 percent with respect to the raw ply-yarns.

We believe that the construction and practise of our novel apparatus and process will now be understood, and that the advantages thereof will be fully appreciated by those persons skilled in the art.

We claim:

1. Process for improving the fiber structure of textile materials containing cellulose fibers in which the textile material is impregnated with an alkali hydroxide solution heated to a temperature of at least 50°C for a period of between 4 and 10 seconds, thereupon cooled to a temperature less than 25°C, stretched and washed, said alkali hydroxide solution being selected from the group consisting of a sodium hydroxide solution of a concentration between about 15° and 30° Be and a lithium hydroxide solution of a concentration of between approximately 5 and 10 percent.

2. Process according to claim 1 in which the alkali hydroxide solution is a sodium hydroxide solution of between 15° and 30° Be.

3. Process according to claim 1 in which the textile material is passed through the storage zone for a period of about 3 seconds during which time alkali hydroxide solution is again applied to the textile material.

4. Process according to claim 1, characterized in that the alkali hydroxide solution is heated to a temperature of between 50° and 95°C.

5. Process according to claim 2, characterized in that the sodium hydroxide solution is heated to a temperature of between 50° and 95°C.

6. Process according to claim 1, characterized in that low-molecular aliphatic alcohols are added to the solution of swelling agents.

7. Process according to claim 2, characterized in that low-molecular aliphatic alcohols are added to the solution of swelling agents.

8. Process according to claim 6, characterized in that the alcohols are added in quantities of between 0.5 and 5 volume percent.

9. Process according to claim 7, characterized in that the alcohols are added in quantities of between 0.5 and 5 volume percent.

10. Process according to claim 1, characterized in that the pull reduction of the textile material is effected during impregnation.

11. Process according to claim 1, characterized in that the textile material, between impregnation with the swelling agent and cooling, is passed through a storage zone.

12. Process according to claim 1, characterized in that in order to effect cooling, the textile material is passed over cooled rollers.

13. Process according to claim 1, characterized in that in order to effect cooling, the textile material is passed through a solution of swelling agent of a temperature of between 0° and 20°C.

14. Process according to claim 1, characterized in that the cooling time is of the order of between 5 and 20 seconds.

15. Process according to claim 1, characterized in that the textile material, in the zone between impregnation with the swelling agent and cooling, is subjected at least in longitudinal direction to shrinkage to a controlled extent.

16. Process according to claim 15, characterized in that the shrinkage is of the order of between 0.5 and 10 percent.

17. Process for improving the fiber structure of textile materials containing cellulose fibers in which the textile material is first impregnated with a sodium hydroxide solution of between 15° and 30° Be heated to at least 50°C for a period of the order of between 4 and 10 seconds, passed through a storage zone, thereupon cooled to a temperature less than 25°C for a period in the order of between 5 and 20 seconds, stretched in longitudinal and transverse direction to a predetermined extent and washed.

18. Process for improving the fiber structure of textile materials containing cellulose fibers in which the textile material is first impregnated with a sodium hydroxide solution of between 15° and 30° Be, heated to a temperature of between about 50° and 95°C, passed through a storage zone, thereupon cooled to a temperature less than 25°C for a period of the order of between 5 and 20 seconds, the textile material being subjected in the zone between impregnating and cooling to controlled shrinkage in longitudinal direction, whereupon the textile material is stretched in longitudinal and transverse direction to a predetermined extent and washed.

19. Process according to claim 17 in which the textile material is passed through the storage zone for a period of about 3 seconds, during which time sodium hydroxide solution of the same concentration is again applied to the textile material.

20. Process according to claim 17 in which low-molecular aliphatic alcohols in quantities of between 0.5 and 5 volume percent are added to the sodium hydroxide solution.

* * * * *